US010392735B2

(12) United States Patent
Artzt et al.

(10) Patent No.: US 10,392,735 B2
(45) Date of Patent: Aug. 27, 2019

(54) CLOTHING CARRIER

(71) Applicant: Graf + Cie AG, Rapperswil (CH)

(72) Inventors: Peter Artzt, Reutlingen (DE); Günter Steinbach, Reutlingen (DE); Volker Jehle, Öhningen (DE)

(73) Assignee: Graf + Cie AG, Rapperswil (CH)

( * ) Notice: Subject to any disclaimer, the term of this patent is extended or adjusted under 35 U.S.C. 154(b) by 135 days.

(21) Appl. No.: 15/029,396

(22) PCT Filed: Oct. 9, 2014

(86) PCT No.: PCT/CH2014/000147
§ 371 (c)(1),
(2) Date: Apr. 14, 2016

(87) PCT Pub. No.: WO2015/054798
PCT Pub. Date: Apr. 23, 2015

(65) Prior Publication Data

US 2016/0273138 A1 Sep. 22, 2016

(30) Foreign Application Priority Data

Oct. 15, 2013 (CH) ..... 1755/13

(51) Int. Cl.
*D04H 1/46* (2012.01)
*D04C 1/06* (2006.01)
*D01G 15/86* (2006.01)

(52) U.S. Cl.
CPC ..... *D04C 1/06* (2013.01); *D01G 15/86* (2013.01)

(58) Field of Classification Search
USPC ..... 442/402, FOR. 110, 168; 19/114
See application file for complete search history.

(56) References Cited

U.S. PATENT DOCUMENTS

| | | | | |
|---|---|---|---|---|
| 3,533,902 | A | 10/1970 | Hoch | |
| 4,356,598 | A | 11/1982 | Graf | |
| 4,594,284 | A | 6/1986 | Nakagawa et al. | |
| 5,891,547 | A * | 4/1999 | Lawless | A44B 18/0011 428/100 |
| 2005/0008813 | A1* | 1/2005 | Demott | B32B 7/08 428/97 |
| 2006/0234587 | A1* | 10/2006 | Horiguchi | D04H 1/46 442/340 |

FOREIGN PATENT DOCUMENTS

| | | | |
|---|---|---|---|
| CH | 636134 | A5 | 5/1983 |
| CH | 704412 | A1 | 7/2012 |
| DE | 1469266 | A1 | 12/1968 |

(Continued)

OTHER PUBLICATIONS

CH Search Report, dated Jan. 24, 2014.
PCT International Search Report, dated Dec. 1, 2014.

*Primary Examiner* — Matthew D Matzek
(74) *Attorney, Agent, or Firm* — Dority & Manning, P.A.

(57) ABSTRACT

A clothing carrier (1) for flexible or semi-rigid clothings is formed from a random fiber sheet consolidated by needling. The random fiber sheet is formed from PES or PA fibers (10) and is impregnated with a polymer (11). The random fiber sheet is laminated with a PUR film (12) to structurally compensate at least one surface of the random fiber sheet.

7 Claims, 1 Drawing Sheet

(56) References Cited

FOREIGN PATENT DOCUMENTS

| | | | | |
|---|---|---|---|---|
| DE | 2013912 | A1 | 10/1970 | |
| DE | 7414314 | U | 4/1974 | |
| DE | 10 2006 016 832 | A1 | 10/2007 | |
| GB | 1020142 | A | 2/1966 | |
| GB | 1 521 001 | A | 8/1978 | |
| GB | 2 436 967 | A | 10/2007 | |
| JP | S 60259633 | A | 12/1985 | |
| WO | WO 2012/103658 | A1 | 8/2012 | |
| WO | WO-2012103658 | A1 * | 8/2012 | ..... D01G 15/86 |

* cited by examiner

CLOTHING CARRIER

FIELD OF THE INVENTION

The present invention relates to a clothing carrier for flexible or semi-rigid clothings used in different areas of processing of textile fibers. A flexible or semi-rigid clothing substantially consists of a clothing carrier and the clothing tips. The clothing tips are formed by wire hooks which are U-shaped. In a so-called setting process, the wire hooks are pierced through the clothing carrier at certain spacing distances and in certain arrangements, wherein the ends of the wire hooks protrude from the clothing carrier and form the clothing tips. The number of clothing tips per unit of area is referred to as tip density. The wire hooks are held in the clothing carrier and have a certain flexibility depending on their shape and length, as well as on the condition of the clothing carrier. Semi-rigid clothings have stronger wire hooks than the flexible clothings. Likewise, in the case of semi-rigid clothings, the clothing carrier is designed to be stronger in the sense of having less flexibility than in the case of flexible clothings.

BACKGROUND OF THE INVENTION

From the prior art, different embodiments of clothing carriers are known, wherein these are usually multi-layered. DE 10 2006 016 832 discloses a clothing carrier comprising at least two layers, a base layer, and a cover layer. The wire hooks are anchored in the base layer. The cover layer, however, enables an undisturbed swinging of the wire hooks, which is important, in particular, in an application in carding. The base layer is formed from a nonwoven, wherein the material of the nonwoven differs from the material of the cover layer.

CH 636 134 discloses a clothing carrier consisting of a basic body having reinforcing inserts embedded therein. The basic body is produced from an elastic plastic and the reinforcing inserts are produced from fabric or fabric layers.

In DE 74 14 314, a known embodiment of clothing carriers consisting of multiple fabric layers is improved in such a way that at least one layer made from a nonwoven is incorporated.

CH 704 412 discloses a clothing carrier consisting of a fiber sheet produced from a certain mixture of different fiber types. Shrinkable fibers, in particular, which undergo thermal treatment in the production process and result in a consolidation of the fiber sheet, are used in this case.

All the clothing carriers known from the prior art have the disadvantage that they are formed of multiple layers or consist of a certain mixture of various fibers, wherein the different layers or the various fibers must be connected to one another. A layered design or the use of different materials in a fiber sheet for a clothing carrier appears to be absolutely necessary since, on the one hand, a strong anchoring of the wire hooks in the clothing carrier and, on the other hand, a certain mobility of the clothing tips as well as their seat in the clothing carrier must be ensured. Another disadvantage of clothing carriers according to the prior art is the relatively weak return forces which return the clothing tips to the original position after every deflection. Another reason therefor is that known clothing carriers wear out after a short time and, as a result, the clothing tips have too much play in the clothing carrier. This results in the so-called over-tearing of the clothing.

SUMMARY OF THE INVENTION

An object of the invention is that of creating a clothing carrier which has a simple design and a tenacity necessary for the anchoring of wire hooks while nevertheless allowing the necessary mobility of the wire hooks. Additional objects and advantages of the invention will be set forth in part in the following description, or may be obvious from the description, or may be learned through practice of the invention.

The object is achieved by the features of a clothing carrier disclosed herein.

In order to solve the problem, a clothing carrier for flexible or semi-rigid clothings is proposed, which clothing carrier is a plaited random fiber sheet consolidated by needling, wherein the random fiber sheet is formed from polyester (PES) fibers or polyamide (PA) fibers and is impregnated with a polymer.

A random fiber sheet is understood to be a textile sheet material comprising fibers or filaments, which sheet material is produced by loosely juxtaposing and stacking irregularly arranged fibers or filaments. In the present invention, a distinction is not made between the use of staple fibers and endless filaments. A fiber sheet can consist of longitudinal, longitudinal and transverse, transverse fibers or filaments or of a complete random orientation, wherein, in the case of a random orientation, the fiber sheet is referred to as a random fiber sheet. If the fibers or filaments are laid out in one direction, this is referred to as a unidirectional fiber sheet.

Polyester (PES) fibers or polyamide (PA) fibers have proven suitable for forming a random fiber sheet in order to obtain the properties essential for a clothing carrier. The fibers are preferably used as staple fibers having a staple length of 30 mm to 80 mm and a fiber count of 1.0 dtex to 5.0 dtex. The specific tenacity is 25 cN/tex to 60 cN/tex. Alternatively, endless filaments having the same fiber count and tenacity can be used.

The random fiber sheet is preferably produced from polyamide fibers. Polyamide fibers have a higher moisture absorption capacity, which is also expressed as a higher wettability, than polyester fibers. Greater adhesion of the polymer, which is used for the impregnation, to the individual fibers is therefore achieved. The polyamide fiber also exhibits greater resiliency after mechanical loading than does the polyester fiber. This means that the polyamide fiber is more likely than the polyester fiber to return to the original state after mechanical loading. In the present application, these mechanical restoring forces result in an increased service life of the clothing carrier.

As is known from the prior art, after the carding process, the fibers used for forming the random fiber sheet are placed on a belt, as a random fiber sheet layer, and are subsequently stacked using a fiber sheet transverse-placement device. The transverse plaiting of multiple random fiber sheet layers results in the formation of a plaited random fiber sheet having a predominant direction of the fibers in the transverse direction. The transverse direction is understood to be orthogonal to a running direction of the belt on which the random fiber sheet layer is placed. The desired weight per unit area of the random fiber sheet portion of the clothing carrier is achieved by means of the plaiting (doubling). In one preferred embodiment, the random fiber sheet is formed from at least 30-60 plaitings, preferably from 40 plaitings.

A plaited random fiber sheet is held together by itself only to a limited extent. In order to improve this limited cohesion, the random fiber sheet is subjected to a needling process which results in fiber sheet consolidation. Needling can be carried out in one or multiple passages. In addition, it is possible to influence the fiber orientation in the fiber sheet by specifically drawing (orienting) the fiber sheet before or after the needling process. As a result, defined force-elongation properties of the fiber sheet can be set in the longitudinal and the transverse direction. The needling effectuates an increase in the density of the random fiber sheet; up to 0.3 $g/cm^3$ is achieved.

After the needling, the random fiber sheet is guided through calender rolls a first time. Differences in thickness are thereby equalized and a defined thickness and density are set.

Durable elasticity is an important property of a clothing carrier. The subsequently utilized clothing tips are loaded in such a way that the wire hooks move back and forth. The clothing carrier must have high durable elasticity so that the fastening of the wire hooks does not wear out. In order to increase the durable elasticity, the clothing carrier is impregnated with a polymer after the first calendering.

In this connection, the polymer, for example latex (acrylonitrile), is provided in the form of an aqueous dispersion. The portion of water is preferably 50 to 70 percent, preferably less than 60 percent. The random fiber sheet is immersed in this dispersion, whereby the random fiber sheet absorbs the dispersion in its hollow spaces. Next, the random fiber sheet is pressed by means of a second calendering in order to remove excess dispersion and, in another step, is stabilized and dried. For the stabilization, an infrared field is usually used, whereby sedimentation of the polymer is prevented. The stabilization and drying of the random fiber sheet can take place in a heated space through which the random fiber sheet is transported. In this connection, the random fiber sheet can be guided through the heated space on belts, rollers, or other suitable means, for example suction drums of a suction drum dryer.

In another embodiment, heated rollers can also be used for stabilizing and drying the random fiber sheet. The heating makes it possible to create smooth surfaces and to set the surface condition of the clothing carrier.

The impregnation also results in an increase in the density. The quantity of polymer embedded in the clothing carrier can be determined on the basis of the change in the portion of polymer in the aqueous dispersion. This affects the elasticity and the density of the clothing carrier; densities of 0.4 $g/cm^3$ to 0.5 $g/cm^3$ are achieved. In this connection, the polymer has a portion of 20 to 60 percent of the weight of the impregnated random fiber sheet.

Advantageously, the impregnated random fiber sheet reaches a specific weight per unit area of more than 1,400 $g/m^2$. It has been shown that impregnated random fiber sheets having a lower specific weight per unit area result in a reduction of the holding forces of the wire hooks pierced therein and, therefore, contribute to the wire hooks wearing out more rapidly. Preferably, the specific weight per unit area of the impregnated random fiber sheet is greater than 1,600 $g/m^2$.

In another embodiment, lamination with a polyurethane (PUR) film is carried out to structurally compensate at least one surface of the random fiber sheet. The PUR film is connected to the random fiber sheet by means of the lamination. Thermal lamination is particularly suitable, in which case the PUR film is applied onto the clothing carrier under the influence of heat and under pressure, for example, with the aid of heated rollers. The PUR film which is used has a thickness of 0.1 mm to 0.5 mm. Preferably, PUR films having a thickness of 0.1 mm to 0.3 mm are used. This coating created by the film has the advantage that the surface of the clothing carrier is easy to clean and fewer adhesions result during use as the fibers are guided past the clothing carrier. In addition, the PUR film contributes to the improvement of the durably elastic properties of the clothing carrier. The PUR film applied onto the random fiber sheet increases the retention force of the random fiber sheet with respect to the subsequently used wire hooks.

Heated rollers or belts are used during the thermal lamination in order to provide the PUR film with a surface structure. A structure on the rollers or belts is transferred to the film by means of the pressure exerted by the rollers or belts onto the PUR film.

In addition, the fiber friction is substantially less on a structured surface than on a smooth surface; the reason for this is that the actual contact surface between a fiber and the surface of the clothing carrier is reduced by the structuring of the surface. The surface of the PUR film preferably has a wavy structure. The wavy structure is transferred to the surface of the PUR film by means of the heated rollers or belts during the lamination.

The surface of the PUR film preferably has a surface roughness Ra of 5 μm to 30 μm, particularly preferably 7 μm to 20 μm. The greatest height difference Rz is more than 30 μm. The characteristic numbers for the surface roughness Ra and Rz are determined using the sampling method according to the Standard DIN EN ISO 4287 (issued in 1998). The nominal characteristics of the sampling instrument which is used are determined by the Standard EN ISO 3274 (issued in 1997).

It has been shown that a structured surface or increased roughness of the surface as compared to a smooth surface of the PUR film enables the fibers to better slide on the surface and results in less dirt adhesion. This also contributes to improved cleaning of the clothing carriers.

In a preferred embodiment, a powder coating for the structural compensation and for increasing adhesion is provided before the lamination. The powder which is used is also a polyester (co-PES). The powder, which is applied in minimal quantities, makes it possible to equalize production-induced irregularities in the random fiber sheet and results in an improvement of the structural compensation to be achieved by the lamination. In this connection, the application of 25 $g/m^2$ to 30 $g/m^2$ powder of co-PES has proven to be particularly suitable. The applied powder is also used as an adhesion promoter and contributes to a better connection between the random fiber sheet and the PUR film. The powder preferably has a fineness of 200 μm to 500 μm.

In another embodiment, one or multiple fiber sheet layers, which are designed as unidirectional fiber sheets, are incorporated into the clothing carrier in order to influence the flexibility. Introducing a unidirectional layer increases the rigidity of the clothing carrier with respect to mechanical loads in directions parallel to the unidirectional direction. The flexibility of the clothing tips in the swinging direction of the clothing tips, for example, can be influenced by a suitable arrangement of the unidirectional layer.

The method for producing a clothing carrier for flexible or semi-rigid clothings includes, inter alia, the following steps:

forming a plaited random fiber sheet made from polyester (PES) fibers or polyamide (PA) fibers needling the plaited random fiber sheet calendering a first time, after the needling, in order to set the thickness and density of the random fiber sheet impregnating the random fiber sheet which has been calendered for the first time calendering the impregnated random fiber sheet a second time in order to set the desired thickness of the random fiber sheet For impregnation, the random fiber sheet is immersed in an aqueous solution of latex, wherein the random fiber sheet soaks up the impregnating material. A second calendering is carried out in order to squeeze out the excess quantity of aqueous solution and to set the final thickness of the random fiber sheet.

The clothing carriers which are common nowadays have a thickness of 3 mm to 4 mm. Other thicknesses of clothing carriers are also possible, however. The clothing carrier is used for producing a flexible or semi-rigid clothing for processing textile fibers. In the production of the clothing, wire hooks are pierced through the clothing carrier in a setting process. The wire hooks form the clothing tips on the surface of the clothing. In the setting process, the wire hooks are arranged with spacing from one another which conforms to the subsequent requirements on the clothing. The number of resultant clothing tips per unit of area is referred to as tip density. The maximum tip density which can be achieved in a setting process is limited due to mechanical particulars of the machines used in the production of the clothings. A minimal spacing distance between the wire hooks cannot be undershot due to the wire geometry and the design of the setting tools.

BRIEF DESCRIPTION OF DRAWINGS

The invention shall be described in greater detail in the following by means of an exemplary embodiment and by reference to drawings.

DETAILED DESCRIPTION

Figure 1:
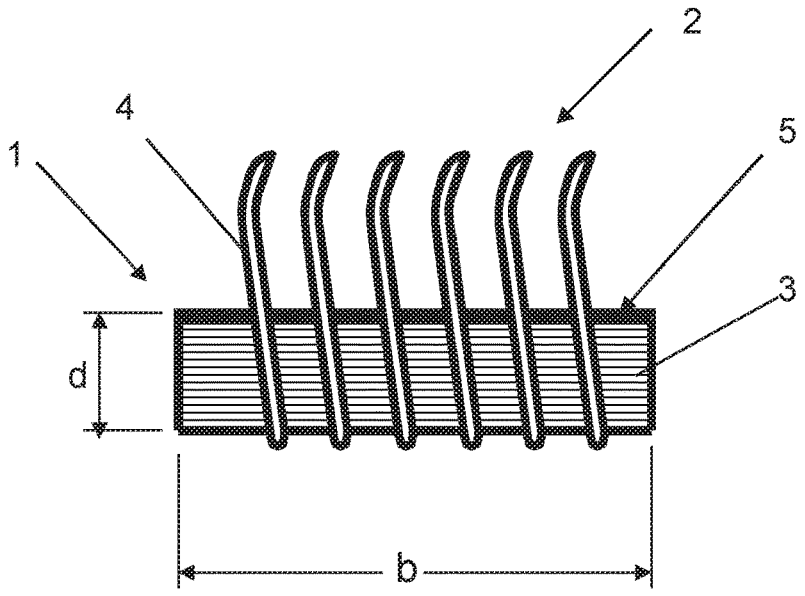
FIG. 1 shows a schematic illustration of a clothing carrier having an inserted flexible clothing according to the prior art.

Reference will now be made to the embodiments of the invention, one or more examples of which are shown in the drawings. Each embodiment is provided by way of explanation of the invention, and not as a limitation of the invention. For example features illustrated or described as part of the one embodiment can be combined with another embodiment to yield still another embodiment. It is intended that the present invention include these and other modifications and variations to the embodiments described herein.

A known clothing carrier 1 having an inserted flexible clothing 2 is shown in FIG. 1. The clothing carrier 1 is composed of multiple woven textile layers 3 which are held together by means of binding agents or by vulcanization with rubber or synthetic rubber. In addition to the textile layers 3, a rubber layer 5 is provided as a cover layer 5. The wire hooks 4 pierced through the clothing carrier 1 are held in the multi-layered fabric 3. The wire hooks 4 are greatly loaded during operation and are anchored accordingly in the multi-layered clothing carrier 1. Flexible clothings 2, as well as semi-rigid clothings, are usually produced in strips having a certain width b and a thickness d and, subsequently, are inserted into so-called flats or are pulled onto rollers.

Figure 2:
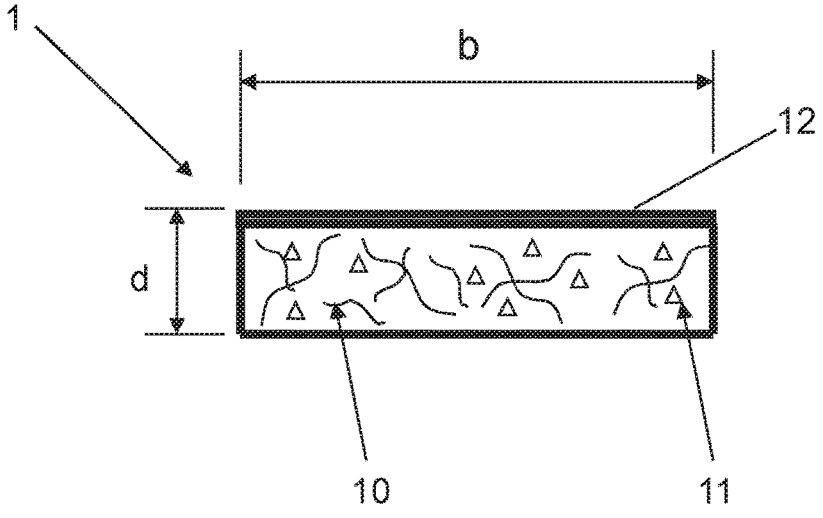
FIG. 2 shows a schematic illustration of a clothing carrier according to the invention.

An embodiment of the clothing carrier according to the invention is schematically illustrated in FIG. 2. The clothing carrier 1 is shown in the illustration as a single layer having a coating 12. The clothing carrier 1 is a plaited random fiber sheet made from PES fibers 10. The plaited random fiber sheet was consolidated by needling and was brought to a certain thickness by means of a first calendering. The clothing carrier 1 was subsequently impregnated in order to incorporate a polymer 11 into the clothing carrier 1. A final, second calendering results in the thickness d. A coating 12 is applied on the top side of the clothing carrier 1 across the entire width b by means of lamination with a PUR film. The top side is the side from which the wire hooks eventually protrude and form the clothing. The applied coating 12 functions not only to improve the surface condition of the clothing carrier 1, so that adhesion of dust and dirt can be reduced, but also to improve the durably elastic properties of the clothing carrier.

The clothing carriers are usually produced as endless strips having a certain length and are fitted with wire hooks, by means of the setting process, in order to form the clothing tips. After conclusion of the entire production process, the clothing carriers fitted with wire hooks are cut into ready-for-use strips having the width b. In this connection, the width b is between 15 mm and 150 mm, depending on the intended use.

Modifications and variations can be made to the embodiments illustrated or described herein without departing from the scope and spirit of the invention as set forth in the appended claims.

LEGEND

1 clothing carrier
2 clothing tips
3 textile layer
4 wire hook
5 cover layer
10 PES fibers or PA fibers
11 polymer
12 coating
d thickness of the clothing carrier
b width of the clothing carrier

The invention claimed is:

1. A clothing carrier (1) for flexible or semi-rigid clothings, comprising:
- a needled, plaited random fiber sheet comprising from 30 to 60 plaited layers;
- wherein the random fiber sheet is formed from polyester (PES) or polyamide (PA) fibers (10) and is impregnated with a polymer material (11);
- a polyurethane (FUR) film (12) laminated to the random fiber sheet that structurally compensates at least one surface of the random fiber sheet;
- a powder coating between the random fiber sheet and the laminated PUR film.

2. The clothing carrier (1) according to claim 1, wherein the PES or PA fibers (10) have a staple length of 30 mm to 80 mm and a fineness of 1.0 dtex to 5.0 dtex.

3. The clothing carrier (1) according to claim 1, wherein the PES or PA fibers (10) have a specific tenacity of 25 cN/tex to 60 cN/tex.

4. The clothing carrier (1) according to claim 1, wherein the random fiber sheet impregnated with the polymer material has a density of 0.4 g/cm3 to 0.5 g/cm3.

5. The clothing carrier (1) according to claim 1, wherein the FUR film (12) has a thickness of 0.1 mm to 0.5 mm.

6. A method for producing the clothing carrier (1) in accordance with claim 1 for flexible or semi-rigid clothings (2), comprising:
- forming a plaited random fiber sheet from polyester (PES) fibers or polyamide (PA) fibers (10), the plaited random fiber sheet comprising from 30 to 60 plaited layers;
- needling the plaited random fiber sheet;
- after the needling, calendaring the random fiber sheet a first time;

after the first calendaring, impregnating the needled random fiber sheet with a polymer (11);

after the impregnation, calendaring the random fiber sheet a second time to bring the random fiber sheet to a constant thickness (d);

laminating a polyurethane (PUR) film to the random fiber sheet with a powder coating between the random fiber sheet and the PUR film.

7. A clothing for processing textile fibers, comprising:

a clothing carrier (1);

clothing tips (2) formed by wire hooks (4) pierced through the clothing carrier (1) in a setting process; and wherein the clothing carrier (1) is in accordance with claim 1.

* * * * *